US009233777B2

(12) United States Patent
Weyrauch et al.

(10) Patent No.: US 9,233,777 B2
(45) Date of Patent: Jan. 12, 2016

(54) PALLET CONTAINER

(71) Applicant: MAUSER-WERKE GMBH, Brühl (DE)

(72) Inventors: Detlev Weyrauch, Kreuzau-Untermaubach (DE); Sebastian Bischoff, Bonn (DE)

(73) Assignee: MAUSER-WERKE GMBH, Bruehl (DE)

( * ) Notice: Subject to any disclaimer, the term of this patent is extended or adjusted under 35 U.S.C. 154(b) by 0 days.

(21) Appl. No.: 14/430,132

(22) PCT Filed: Sep. 13, 2013

(86) PCT No.: PCT/EP2013/002753

§ 371 (c)(1),
(2) Date: Mar. 20, 2015

(87) PCT Pub. No.: WO2014/044372

PCT Pub. Date: Mar. 27, 2014

(65) Prior Publication Data

US 2015/0239608 A1 Aug. 27, 2015

(30) Foreign Application Priority Data

Sep. 21, 2012 (DE) ..... 20 2012 009 327 U
Jan. 18, 2013 (DE) ..... 20 2013 000 624 U

(51) Int. Cl.
*B65D 19/00* (2006.01)
*B65D 19/06* (2006.01)
(Continued)

(52) U.S. Cl.
CPC ..... *B65D 19/06* (2013.01); *B65D 19/385* (2013.01); *B65D 77/0466* (2013.01); *B65D 2213/02* (2013.01); *B65D 2519/00024* (2013.01);
(Continued)

(58) Field of Classification Search
CPC combination set(s) only.
See application file for complete search history.

(56) References Cited

U.S. PATENT DOCUMENTS 5,253,777 A 10/1993 Schutz
5,673,630 A 10/1997 Schutz
(Continued)

FOREIGN PATENT DOCUMENTS

DE 41 08 399 10/1992
DE 42 06 945 3/1993
(Continued)

OTHER PUBLICATIONS

Copy of International Search Report issued by the European Patent Office in International Application PCT/EP2013/002753.

*Primary Examiner* — Jacob K Ackun
(74) *Attorney, Agent, or Firm* — Henry M. Feiereisen LLC.

(57) ABSTRACT

A pallet container for storing and transporting liquid filling materials includes an exchangeable thin-walled inner container of thermoplastic, and a tubular lattice frame closely enclosing the inner container and made of vertical and horizontal tubular bars. The tubular lattice frame is fastened to the upper outer rim of a bottom pallet having a flat pallet top deck which includes a sheet-metal plate for supporting the inner container and a pallet substructure having four corner feet, four middle feet arranged there between, and a steel-tube base ring that is horizontally peripheral on the bottom side. The pallet substructure has four individual tube sections which extend diagonally directly beneath the metal plate and are each fastened to two adjacent middle feet to form a diamond-shaped supporting frame beneath the bottom plate. The tube sections are connected to base ring in an electrically conductive manner via corresponding screw connections.

13 Claims, 3 Drawing Sheets

Figure 1:
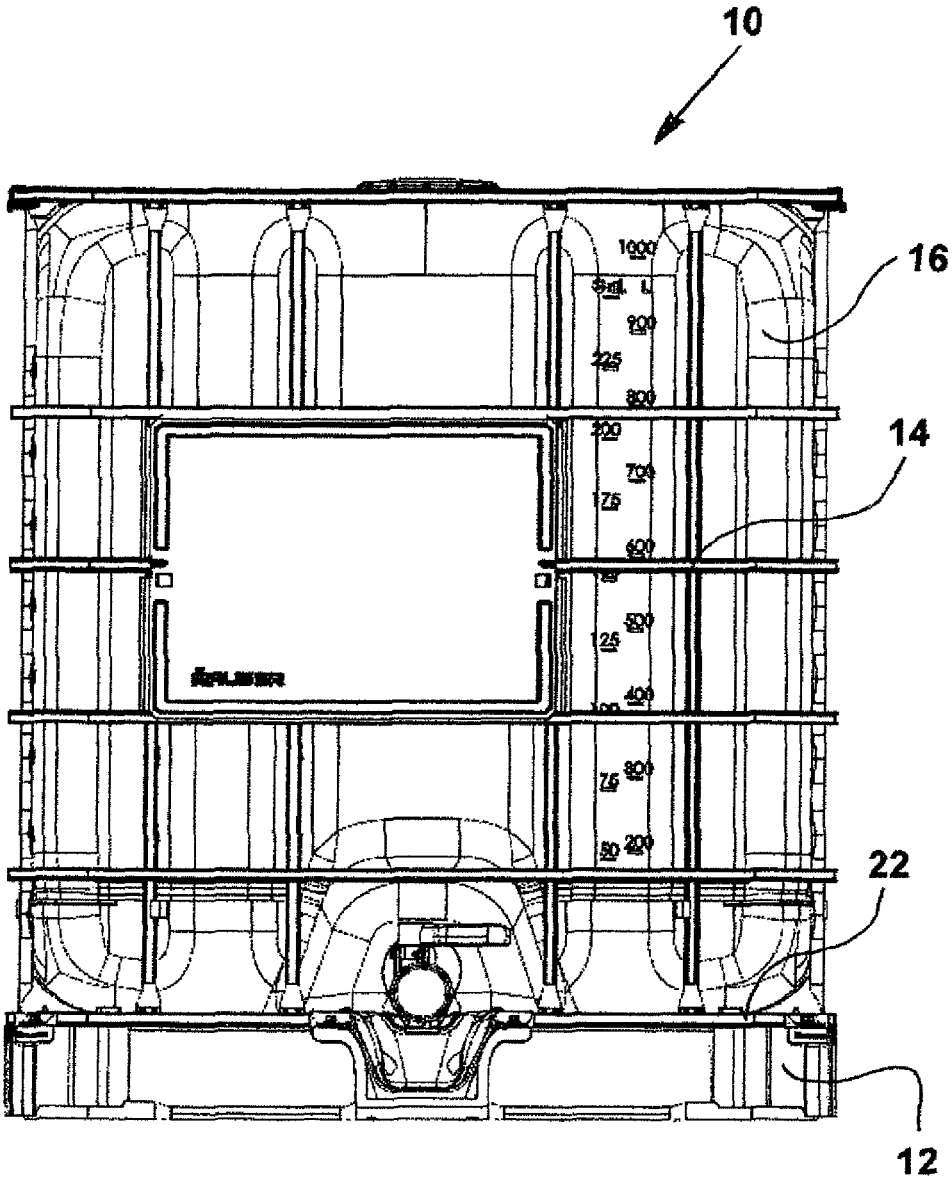

(51) Int. Cl.
*B65D 77/04* (2006.01)
*B65D 19/38* (2006.01)

(52) U.S. Cl.
CPC ..... *B65D2519/00059* (2013.01); *B65D 2519/00094* (2013.01); *B65D 2519/00104* (2013.01); *B65D 2519/00174* (2013.01); *B65D 2519/00273* (2013.01); *B65D 2519/00288* (2013.01); *B65D 2519/00333* (2013.01); *B65D 2519/00373* (2013.01); *B65D 2519/00567* (2013.01); *B65D 2519/00572* (2013.01)

(56) References Cited

U.S. PATENT DOCUMENTS

| | | | | |
|---|---|---|---|---|
| 5,738,240 | A | 4/1998 | Vavra et al. | |
| 6,293,400 | B1 * | 9/2001 | Arai | B65D 19/0026 206/386 |
| 7,296,374 | B2 | 11/2007 | Weyrauch | |
| 7,908,980 | B2 | 3/2011 | Schmidt | |
| 8,863,978 | B2 | 10/2014 | Przytulla et al. | |
| 2002/0078558 | A1 | 6/2002 | Gangloff et al. | |
| 2002/0112979 | A1 | 8/2002 | Maschio | |
| 2004/0107879 | A1 | 6/2004 | Schutz | |
| 2004/0195129 | A1 * | 10/2004 | Richter | B65D 77/0466 206/386 |
| 2006/0011637 | A1 | 1/2006 | Schmidt | |
| 2007/0199845 | A1 * | 8/2007 | Hartwall | B65D 19/0026 206/386 |
| 2008/0257230 | A1 | 10/2008 | Cassina | |
| 2009/0000525 | A1 | 1/2009 | Schmidt et al. | |
| 2009/0008397 | A1 | 1/2009 | Schmidt | |
| 2009/0152151 | A1 * | 6/2009 | Schubbach | C08L 23/807 206/386 |
| 2010/0200579 | A1 | 8/2010 | Schmidt et al. | |
| 2012/0074138 | A1 | 3/2012 | Schütz | |

FOREIGN PATENT DOCUMENTS

| | | |
|---|---|---|
| DE | 100 50 920 | 5/2002 |
| DE | 20 2006 001 222 | 7/2007 |
| EP | 0 673 846 | 9/1995 |
| EP | 1 232 961 | 8/2002 |
| EP | 1 426 299 | 6/2004 |
| EP | 1 481 918 | 2/2008 |
| EP | 1 982 924 | 10/2008 |
| EP | 2 433 880 | 3/2012 |
| WO | WO 2012/085941 | 6/2012 |

* cited by examiner

PALLET CONTAINER

CROSS-REFERENCE TO RELATED APPLICATIONS

This application is the U.S. National Stage of International Application No. PCT/EP2013/002753, filed Sep. 13, 2013, which designated the United States and has been published as International Publication No. WO 2014/044372 and which claims the priorities of German Patent Applications, Serial No. 20 2012 009 327.4, filed Sep. 21, 2012, and Serial No. 20 2013 000 624.2, filed Jan. 18, 2013, pursuant to 35 U.S.C. 119(a)-(d).

BACKGROUND OF THE INVENTION

The present invention relates to a pallet container for storing and transporting in particular hazardous liquid filling materials, having an exchangeable thin-walled inner container made of thermoplastic for receiving the filling material, having a tubular lattice frame which closely encloses the inner container as a supporting casing and is made of welded-together vertical and horizontal tubular bars, said tubular lattice frame being fastened to the upper outer rim of a bottom pallet that is suitable for fork-lift trucks, wherein the rectangular bottom pallet has a flat pallet top deck, consisting of a thin sheet-metal plate, for supporting the lifted inner container, and a pallet substructure having four corner feet and four middle feet arranged therebetween and made of thermoplastic, and has a rectangular steel-tube base ring that is horizontally peripheral on the bottom side, wherein the bottom pallet is provided with means for discharging electric charges.

The pallet is equipped, between the pallet top deck and the peripheral bottom ring and between the corner and middle feet with in each case a corresponding recess for the insertion of the forks of a fork-lift truck. The pallet can be passed beneath from all four sides in the longitudinal or transverse direction. Such filled pallet containers having a filling volume of approximately 1000 liters with a conventional pallet size of 1200 mm×1000 mm can have a weight of well over 1 t, depending on the specific weight of the liquid filling material, and are only able to be handled with fork-lift trucks. In this case, the shorter pallet sides (1000 mm) are designated the front and rear sides and the two longer pallet sides (1200 mm) are designated the longitudinal sides. An extraction fitting is conventionally arranged centrally in the front side at the bottom of the plastics inner container.

In order to transport hazardous liquid filling materials, such pallet containers have to have official authorization for their specific design. If combustible or explosive liquids are intended to be conveyed in such pallet containers, these containers require a very particular official authorization, in which it is demonstrated that design measures provided ensure that electric charges are discharged, and reliably prevent the containers from being able to become electrically charged (formation of sparks), thereby ruling out a risk of explosion.

Prior Art

In order to ensure an ability to electrically discharge disadvantageous electrical charging in the entire system of pallet containers, pallet containers that are known from EP 1 481 918 B1 (Ro-Fust) or EP 2 433 880 A1 (Sch) and have wooden pallets or pallets which have electrically nonconductive plastics feet require particular measures in the form of electrical discharge plates on or within at least one pallet foot. Also known are plastics feet that are electrically conductive as a whole, having a high content of conductive carbon black. However, these plastics feet that are conductive themselves have, on account of the incorporated conductive carbon black, greatly reduced breaking strength and are thus not usable in all sectors of use. Thus, various tests need to be passed for hazardous-materials authorization during official testing, these tests including, for example, cold drop tests. Pallet containers having plastics feet with a high conductive carbon black content do not generally pass such drop tests.

SUMMARY OF THE INVENTION

Objective

It is the object of the present invention to specify a pallet container of the particular type, which, while exhibiting increased overall stability of the bottom pallet, also meets the condition of multilateral discharging of electric charges.

Solution

This object is achieved by a pallet container for storing and transporting in particular hazardous liquid filling materials, having an exchangeable thin-walled inner container made of thermoplastic for receiving the filling material, having a tubular lattice frame which closely encloses the inner container as a supporting casing and is made of welded-together vertical and horizontal tubular bars, the tubular lattice frame being fastened to the upper outer rim of a bottom pallet that is suitable for fork-lift trucks, wherein the rectangular bottom pallet has a flat pallet top deck, consisting of a thin sheet-metal plate, for supporting the fitted inner container, and a pallet substructure having four corner feet and four middle feet arranged there between and made of thermoplastic, and has a rectangular steel-tube base ring that is horizontally peripheral on the bottom side, wherein the bottom pallet is provided with means for discharging electric charges, wherein the pallet substructure has an upper tubular frame having four individual tube sections of equal length which extend diagonally directly beneath the metal plate and are fastened by way of their ends to in each case two adjacent middle feet such that a diamond-shaped supporting frame, on which the metal plate is spanned, is formed beneath the metal plate, wherein the four individual tube sections are connected to the bottom-side steel-tube base ring, which represents the lower tubular frame, in an electrically conductive manner via corresponding screw connections.

In the construction according to the invention, in order to prevent electrical charging, provision is made for the pallet substructure to have an upper tubular frame having four individual tube sections of equal length which extend diagonally in direct contact beneath the metal plate and are fastened by way of their ends to in each case two adjacent middle feet such that a diamond-shaped supporting frame, on which the metal plate is spanned, is formed beneath the metal plate, wherein the four individual tube sections are connected to the bottom-side steel-tube base ring, which represents the lower tubular frame, in an electrically conductive manner via corresponding screw connections.

In one design of the invention, provision is made for the four individual tube sections each to be bent in a right-angled manner at their ends, each to be plugged into a corresponding recess in two adjacent plastics middle feet by way of the bent end piece and to be connected to the bottom-side base ring in an electrically conductive manner via in each case two screw connections. To this end, the bent end pieces of the four tube sections are screw-connected to the bottom-side base ring such that overall an eightfold electrical connection is provided via this metallic screw connection.

In a further advantageous configuration of the invention, provision is made for the bent end pieces of the four tube sections to be laterally indented in a star-shaped manner shortly above the tube ends so as to form a reduced tube cross section into which an internal thread for a screw connection to the bottom-side base ring is indented. In this way, it is possible to dispense with long fastening screws and locknuts. The fastening screws are thus kept comparatively short. In a particular design feature, the recesses within the plastics middle foot end shortly above the base tube and have a conical tube-centering means there in order to receive the downwardly open tube ends of the bent end pieces, a central bore for passing through the fastening screw being provided in said tube-centering means. In a very expedient manner, this central bore in the conical tube-centering means is formed with a slightly narrowing diameter from bottom to top toward the cone tip, wherein the diameter in the region of the cone tip is configured to be slightly smaller than the diameter of the fastening screw. As a result of this mutually coordinated design of the components, the fastening screws are fixed firmly in the tube-centering means of the plastics feet by way of the tube ends, positioned on the conical tube-centering means, of the bent end pieces in the screw-connected state, and are thus fastened optimally against loosening by themselves, for example on account of transportation shocks.

A further advantageous embodiment of the pallet container according to the invention is that the bottom-side base ring on each plastics middle foot is provided in each case with two corresponding holes for passing through the fastening screws for screwing into the bent end pieces of the four diagonally extending tube sections, wherein the base ring has a conical depression at each of the holes on its underside, such that the screw head of a cap screw or countersunk-head screw is countersunk in a flush manner with the tube underside. This has the effect, for example, that the pallet underside is formed in a smooth and planar manner and the pallet containers can run easily and smoothly—without rattling or getting caught—on the rollers of roller conveyors (roller conveyor belt). In the same way, provision is made according to the present invention for the bottom-side base ring to have a connecting region in which its two tube ends are connected together, and for this connecting region to be arranged beneath a plastics corner foot at a location having a low bending load. In particular when filled pallet containers are being stacked in high-bay warehouses, this has the advantage that the connecting region of the base ring in the high rack always comes to rest on a shelf and is thus supported and no longer hangs freely, wherein this connecting region, which is sensitive to bending loads, previously always tended to sag.

The invention is described and explained in more detail in the following text with reference to exemplary embodiments that are schematically illustrated in the drawings, in which:

BRIRF DESCRIPTION OF THE DRAWING

Figure 2:
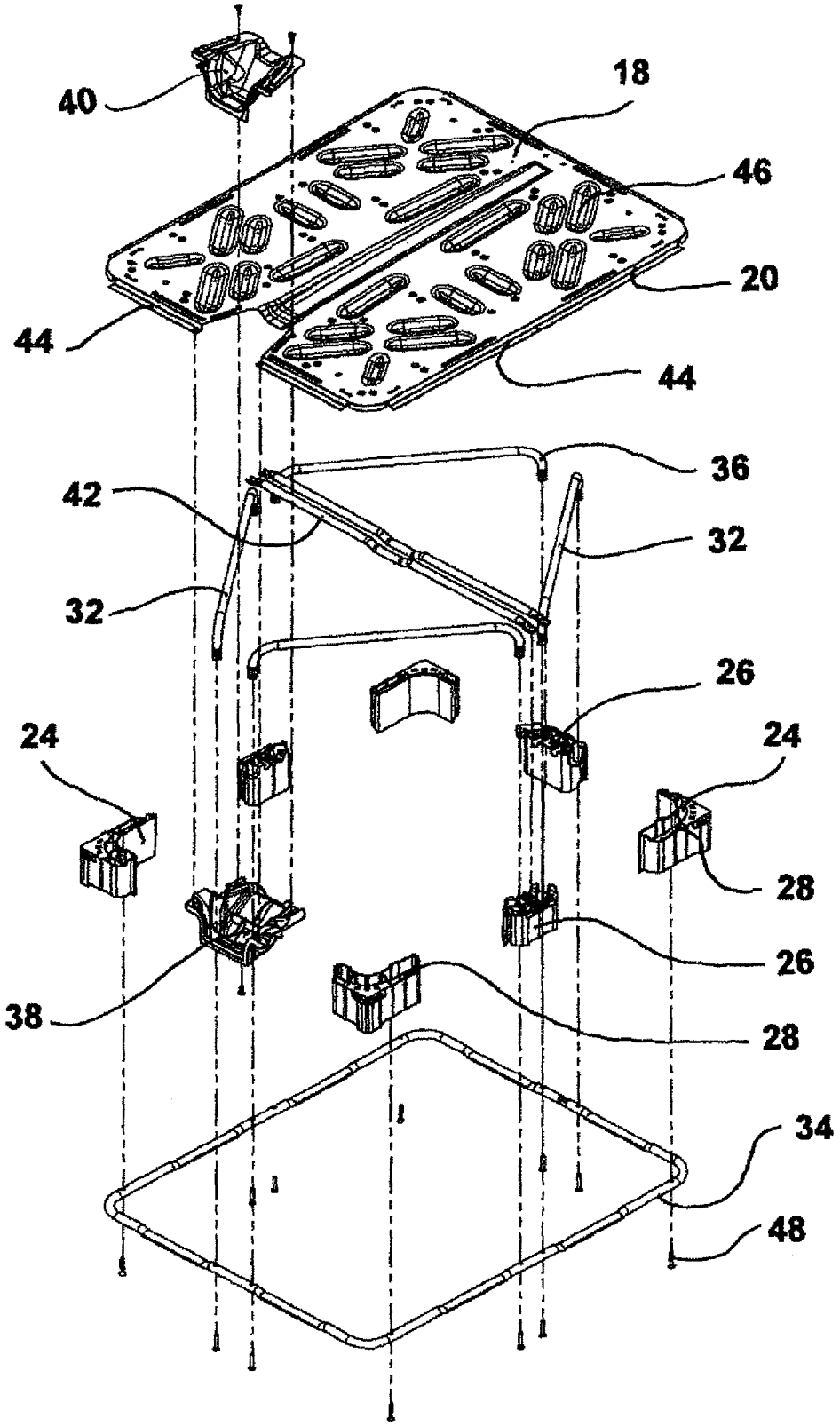
Figure 3:
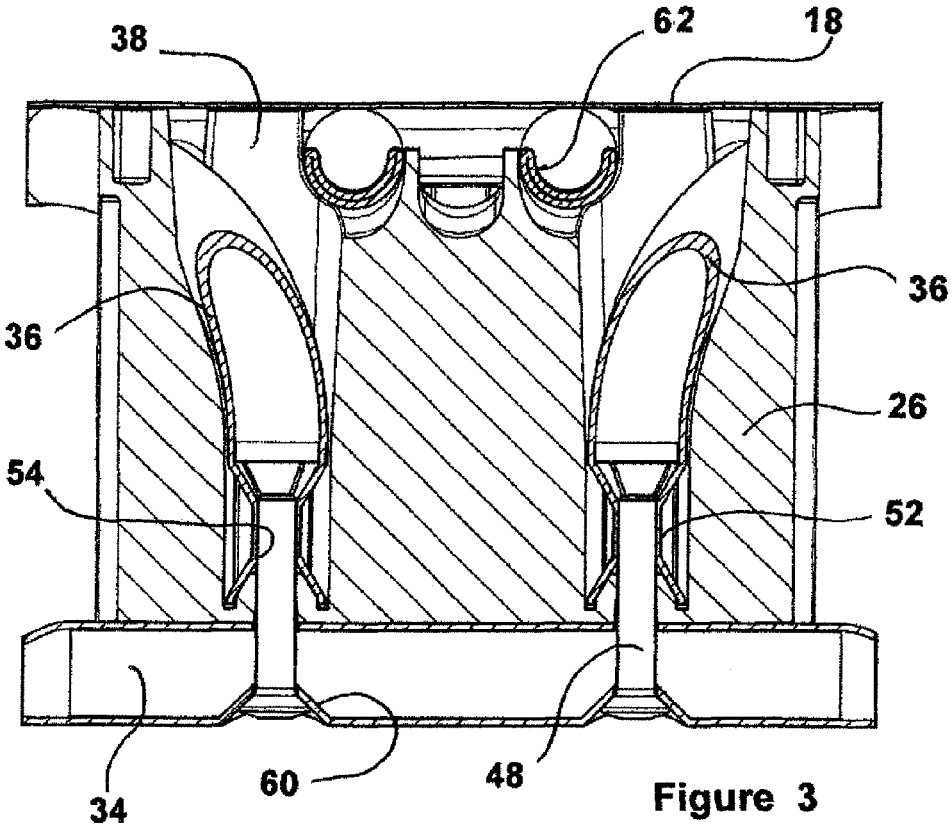
Figure 4:
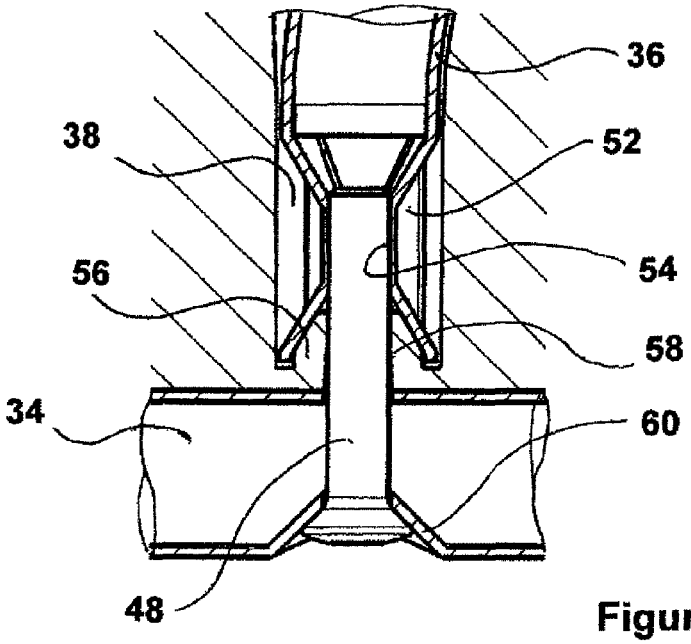

FIG. 1 shows a side view from the front of a pallet container according to the invention, FIG. 2 shows a bottom pallet according to the invention with an exploded illustration of the individual components, FIG. 3 shows a partial section through a plastics middle foot with fitted tubes of the pallet supporting-tube structure, and FIG. 4 shows an enlarged partial view from FIG. 3 with particular tube fastening.

DETAILED DESCRIPTION OF PREFERRED EMBODIMENTS

In FIG. 1, a pallet container of lightweight construction of the "composite IBC" (IBC=Intermediate Bulk Container) type is designated by the reference numeral 10. The pallet container 10 is provided with official hazardous-materials authorization for the storage and transportation of in particular hazardous liquid filling materials and has an exchangeable plastics inner container 16, a supporting casing which closely encloses the plastics inner container 16 and is made of a tubular lattice frame 14, and a bottom pallet 12. The tubular lattice frame 14 is fastened to the upper outer rim of the pallet 12, wherein the rectangular pallet 12 has a thin metal plate 18 as flat pallet top deck for supporting the fitted plastics inner container 16, and a pallet substructure having four corner feet 28, having four middle feet 26 arranged therebetween and having a horizontally peripheral steel-tube bottom ring or rectangular base ring 34. A particular screw-connection of the tubular lattice frame 14 via the bottommost peripheral horizontal tube of the tubular lattice frame 14 to the L-shaped outer rim of the metal plate 18 and the tubes of the pallet supporting-tube structure to the bottom-side base ring 34 ensures elegant and reliable discharging, invisible from the outside, of electric charges.

As is apparent from the exploded illustration of the bottom pallet 12 in FIG. 2, the metal plate 18 is formed in a completely flat and planar manner, without inclinations, slopes or upwardly projecting peripheral rim beads or deeper reinforcing beads. The rectangular metal plate 18 has at each of its four outer sides an L-shaped outer rim with a vertically downward-facing folded edge 20 and an adjoining L-shaped folded edge 44 that faces horizontally outward, which pressed, by the tubular lattice frame 14 that is positioned from above with its bottommost horizontally peripheral lattice-frame tube 22 against the corner feet 24 and middle feet 26 arranged beneath the metal plate 18, into a recess 28 that is provided there and is adapted to the folded edges 20, 44, and fixed such that the planar rectangular metal plate 18 is spanned in the manner of a trampoline externally in a linear manner on the pallet substructure. In this case, the pallet substructure is formed as a tubular-frame supporting structure which has four tubes 32 that extend in a diamond-shaped manner with respect to one another and two parallel transverse tubes 42 in an upper plane directly beneath the metal plate 18, and a rectangular peripheral base tube 34 in a lower plane beneath the plastics feet, wherein the tubes 32 of the upper plane. are connected to the base tube 34 in the lower plane via the four middle feet 26. The four tubes 32 that extend in a diamond-shaped manner with respect to one another are downwardly angled at their ends and are connected, preferably screw-connected, to the base tube 34 via these angled tube ends 36, which are each plugged into two adjacent middle feet 26. Thus, the bent end pieces 36 of two adjacent diagonal tubes 32 are plugged into each plastics middle foot 26. The tubes 32 having the angled tube ends 36 are advantageously all formed in an identical manner for cost-effective manufacture. The transverse tubes 42 are formed in a slightly arcuate manner over a short section in the central region, and they extend there transversely to the collecting channel indented in the metal plate 18. The ends of the transverse tubes 42 are mounted in a form-fitting manner and fixed in a force-fitting manner in the two middle feet 26 on the long lateral edges of the pallet. The anchoring of the metal plate 18 for the linear absorption of tensile forces takes place here, too, largely via the length of the above-described doubled L-shaped angling of the metal-plate outer rim, which is fixed by the positioned lattice frame. The front middle foot, which is arranged beneath the extraction fitting of the inner container, consists of two parts, specifically a cup-shaped lower part 38 and an obliquely formed bowl-shaped upper part 40. The bowl-like upper part 40 is fastened so as to be easily exchangeable and can be easily replaced during reconditioning, for example following contamination with aggressive filling materials after an intended multiple use of the pallet container, The rectangular metal plate 18 has, in the region of the engagement means for the forks of a fork-lift truck, indentations 46 or what are referred to as beads that are introduced from the top downward; in each case at least two mutually parallel protective beads that extend overall diagonally but are formed in a comparatively short manner are impressed in all four quadrants. The central collecting channel in the metal plate 18 is formed in a manner corresponding to the conventional downwardly formed collecting channel in the bottom of the plastics inner container and is likewise indented downwardly into the metal plate 18. The protective beads, which are all downwardly indented, are intended to prevent the forks of a fork-lift truck from accidentally being able to engage between the thin metal plate 18 and the upper tube structure. These indentations 46 which are impressed parallel to the tubes of the upper supporting structure and are formed in a somewhat shallower manner than the diameter of the tubes thus represent a lateral protective wall for the tubes extending under the metal plate, such that incorrect insertion of the forks of a fork-lift truck is reliably prevented. The diagonal arrangement of the four tube sections of the upper tubular frame in the case of 4-fold introducibility of the forks of a fork-lift truck ensures, even in the case of an incomplete (for example only 80%) introduction depth, that all four diagonal tubes are always used as fork bearing points for the forks of the fork-lift truck, such that the entire weight of the filled pallet container is supported by the upper tubes 32, 42 of the supporting structure and the metal plate is kept free of direct contact with the forks, and deformations, caused thereby, of the metal plate as was previously conventional are ruled out.

The two transverse tubes in the upper plane of the tubular-frame supporting structure firstly have the function of pressure tubes for stabilizing the end points of the two lateral middle feet for the diamond-shaped spanning of the thin metal plate. Secondly, with their flexural rigidity, they serve for the surface-area support of the metal plate. A further important function of the transverse tubes is that of stabilizing the middle feet on the pallet outer sides, in order that they cannot "tip" on the base ring. The bottom-side base ring 34 has a connecting region in which its two tube ends are connected together. This connecting region is now arranged beneath a plastics corner foot 24 at a point with little bending load in order to increase the pallet rigidity.

FIG. 3 illustrates in more detail a partial section through a plastics middle foot 26 of the advantageous assembly of the pallet construction and the multiple electrically conductive connection of the tubular lattice frame to the steel-tube base ring 34 via the bottommost horizontally extending lattice tube, via the thin metal plate 18, through the plastics feet 26 is clear. The ends of the parallel transverse tubes are configured in a slightly angled manner and as double-walled half tubes 62 in the region of their mounting in the lateral middle feet 26; they are placed in a form-fitting manner in corresponding recesses in the middle feet 26 and are fixed and firmly clamped in the mounted state and in a force-fitting manner by the firmly screw-connected bottommost lattice-frame tube, extending transversely thereabove, of the tubular lattice frame.

The bent end pieces 36 of the four tube sections 32 are each laterally indented in a star-shaped manner shortly above the downwardly facing tube ends so as to form a reduced tube cross section 52 into which an internal thread 54 for a screw connection of the fastening screws 48 to the bottom-side base ring 34 is indented, for example rolled in or cut in. The recesses within the plastics middle foot 26 end shortly above the base tube 34. In each case a conical tube-centering means 56 is formed there in order to receive the downwardly open tube ends of the bent end pieces 36, a central bore 58 for passing through the fastening screw 48 being provided in said tube-centering means 56.

FIG. 4 shows an enlarged partial view from FIG. 3 with the particular fastening of the bent end pieces 36. To this end, the central bore 58 in the conical tube-centering means 56 is formed with a slightly narrowing diameter from bottom to top toward the cone tip, wherein the diameter in the region of the cone tip is configured to be slightly smaller than the diameter of the fastening screws 48. This brings about nonreleasable firm clamping of the fastening screws 48 in the firmly screw-connected mounted state.

In the detailed Figures of the drawing, it is furthermore apparent that the bottom-side base ring 34 on each plastics middle foot 26 has two corresponding holes for passing through the fastening screws 48 for screwing into the bent end pieces 36 of the four diagonally extending tube sections 32, wherein the bottom-side base ring 34 has a conical depression 60 at each of the holes on its underside, such that the screw head of a cap screw or countersunk-head screw is countersunk in a flush manner into the underside of the base ring 34. The purpose of this is that the pallet underside is formed in a smooth and planar manner and in particular the filled pallet containers can run easily and smoothly—without rattling or getting caught—on the rollers of roller conveyors (roller conveyor belt).

With the embodiments according to the invention of the composite pallet SM13, compared with known pallet containers, in which the main load is transmitted by the two middle feet to the long pallet sides at the ends of a solid cross member, improved and more uniform load distribution to all pallet feet is achieved. As a result of the particular design with the better load distribution, the new pallet SM13 has less sagging overall than all other comparable known pallets that are available on the market. Via the metal screw connection of the bent end pieces 36 of the four diagonal tube sections 32 to the bottom-side base ring 34, a multiple electrical connection is provided in an elegant manner.

What is claimed is:

1. A pallet container for storing and transporting a liquid filling material, comprising:

a bottom pallet configured for discharging electric charges and having a pallet top deck which includes a thin sheet-metal plate and a pallet substructure having four corner feet, four middle feet arranged between the corner feet, and a steel-tube base ring disposed horizontally peripheral on a bottom side of the bottom pallet, said pallet substructure having an upper tubular frame having four individual tube sections of equal length and extending diagonally directly beneath the sheet-metal plate, each said tube section having ends which are bent at a right angle to define end pieces which are inserted into recesses of two adjacent middle feet such that a diamond-shaped supporting frame is formed beneath the sheet-metal plate for securement of the metal plate;

an exchangeable thin-walled inner container placed on the pallet top deck and made of thermoplastic for receiving the filling material;

a tubular lattice frame configured to closely enclose the inner container as a supporting casing and made of welded-together vertical and horizontal tubular bars, said tubular lattice frame being secured to an upper outer rim of the bottom pallet; and fastening screws configured to connect the tube sections of the tubular frame to the base ring in an electrically conductive manner.

2. The pallet container of claim 1, wherein the bottom pallet has a rectangular configuration.

3. The pallet container of claim 1, wherein the corner feet and the middle feet are made of thermoplastic.

4. The pallet container of claim 1, wherein the steel-tube base ring has a rectangular configuration.

5. The pallet container of claim 1, wherein the fastening screws connect the end pieces of each of the four tube sections to the base ring and are made of metal to establish an eightfold electrical connection.

6. The pallet container of claim 1, wherein the end pieces of the four tube sections are laterally indented in a star-shaped manner slightly inwardly of the ends of the tube sections so as to provide an area of reduced cross section into which an internal thread is formed for the fastening screws to connect the tube sections to the base ring.

7. The pallet container of claim 1, wherein the recesses of the middle feet end slightly inwards of the base tube, with a conical tube-centering section being formed there in order to receive downwardly open ends of the end pieces and having each a central bore for passage of the fastening screw.

8. The pallet container of claim 7, wherein the central bore in the conical tube-centering section has a slightly narrowing diameter from bottom to top toward a cone tip, with the diameter in a region of the cone tip being slightly smaller than a diameter of the fastening screw.

9. The pallet container of claim 1, wherein the base ring on each middle foot has two corresponding holes for passage of the fastening screws for threaded engagement into the end pieces of the tube sections, said base ring having an underside formed with a conical depression at each of the holes, such that a screw head of the fastening screws is countersunk in a flush manner.

10. The pallet container of claim 9, wherein the fastening screws are each a cap screw or a countersunk-head screw.

11. The pallet container of claim 1, wherein the base ring has two tube ends which are connected in a connecting region which is arranged beneath one of the corner feet at a location subject to low bending load.

12. The pallet container of claim 2, wherein the tubular frame of the pallet substructure includes two further transverse tubes which extend parallel and in close proximity to one another, said transverse tubes having ends respectively mounted and fixed in two of the middle feet positioned on long pallet sides of the bottom pallet.

13. The pallet container of claim 2, wherein the ends of the transverse tubes are configured as double-walled half tubes in a region of their support in the middle feet, said ends of the transverse tubes being fixed in a mounted state in a form-and force-fitting manner by the tubular lattice frame extending transversely there above, as the tubular lattice frame is firmly screw-connected to the bottom pallet.

* * * * *